US010851975B2

(12) United States Patent
Cain et al.

(10) Patent No.: US 10,851,975 B2
(45) Date of Patent: Dec. 1, 2020

(54) MIXER CARRIAGE FOR A CONTROL CONSOLE AND CONTROL CONSOLE

(71) Applicant: STAGE TEC ENTWICKLUNGSGESELLSCHAFT FUER PROFESSIONELLE AUDIOTECHNIK MBH, Berlin (DE)

(72) Inventors: Klaus Cain, Berlin (DE); Harald Klaus, Berlin (DE); Helmut Jahne, Berlin (DE); Arno Schuenemann, Berlin (DE)

(73) Assignee: Stage Tec Entwicklungsgesellschaft fuer professionelle Audiotechnik mbH, Berlin (DE)

( * ) Notice: Subject to any disclaimer, the term of this patent is extended or adjusted under 35 U.S.C. 154(b) by 455 days.

(21) Appl. No.: 15/527,865

(22) PCT Filed: Nov. 19, 2015

(86) PCT No.: PCT/EP2015/077170
§ 371 (c)(1),
(2) Date: May 18, 2017

(87) PCT Pub. No.: WO2016/079274
PCT Pub. Date: May 26, 2016

(65) Prior Publication Data

US 2018/0347795 A1 Dec. 6, 2018

(30) Foreign Application Priority Data

Nov. 19, 2014 (DE) ..... 10 2014 223 573

(51) Int. Cl.
*H04H 60/04* (2008.01)
*F21V 21/14* (2006.01)
(Continued)

(52) U.S. Cl.
CPC ..... *F21V 21/14* (2013.01); *F21V 21/10* (2013.01); *F21V 23/02* (2013.01); *F21V 33/00* (2013.01)

(58) Field of Classification Search
CPC ..... F21W 2131/406; F21V 33/0048; A47B 23/04; A47B 23/06; A47B 23/0048
See application file for complete search history.

(56) References Cited

U.S. PATENT DOCUMENTS 3,790,770 A * 2/1974 Stern ..... A47B 23/06 362/98
5,016,852 A * 5/1991 Herendeen ..... A47B 23/02 248/447.2
(Continued)

FOREIGN PATENT DOCUMENTS

CN 102541077 A 7/2012
DE 9201334 U1 6/1992
(Continued)

*Primary Examiner* — Andrew J Coughlin
(74) *Attorney, Agent, or Firm* — Laurence A. Greenberg; Werner H. Stemer; Ralph E. Locher

(57) ABSTRACT

A mixer carriage for an audio, video and/or lighting control console contains a tray body with a tray surface and a coupler for movable coupling to the audio and/or video and/or lighting control console, so that the mixer carriage is moveable relative to a user interface of the audio, video and/or lighting control console. The tray body has at least one lighting device on it for illuminating the tray surface.

17 Claims, 4 Drawing Sheets

(51) Int. Cl.

| | |
|---|---|
| ***F21V 33/00*** | (2006.01) |
| ***F21V 21/10*** | (2006.01) |
| ***F21V 23/02*** | (2006.01) |

(56) References Cited

U.S. PATENT DOCUMENTS

| | | | | | |
|---|---|---|---|---|---|
| 5,377,946 | A * | 1/1995 | Pannu | A47B 23/002 | 248/456 |
| 5,456,440 | A * | 10/1995 | Sideris | A47B 23/04 | 108/27 |
| 7,201,353 | B1 * | 4/2007 | Freeman | A47B 19/06 | 248/161 |
| 10,048,928 | B2 * | 8/2018 | Heiniger | G06F 3/165 | |
| 2013/0235569 | A1 * | 9/2013 | McGowan | F21V 33/0048 | 362/223 |
| 2016/0143434 | A1 * | 5/2016 | Cook | F16M 13/00 | 248/447.1 |

FOREIGN PATENT DOCUMENTS

| | | | |
|---|---|---|---|
| DE | 4405866 | A1 | 8/1995 |
| DE | 202012000440 | U1 | 4/2012 |
| EP | 1143193 | A2 | 10/2001 |

* cited by examiner

A-B

MIXER CARRIAGE FOR A CONTROL CONSOLE AND CONTROL CONSOLE

BACKGROUND OF THE INVENTION

Field of the Invention

The invention relates to a mixer carriage for a control console, in particular for an audio and/or video and/or lighting control console and a piece of control equipment, in particular audio and/or video and/or lighting control equipment, that comprises an audio and/or video and/or lighting control console and a mixer carriage.

In the prior art, the control of audio signals or also light on a stage or in a room and/or the control of video signals for one or more displays and/or the recording of video signals are [done] using so-called control consoles. These have a user interface with multiple controls and control devices, which are, for example, in the form of switches, faders, joysticks, buttons, touch screens, etc. Especially control consoles with such a user interface that are used for controlling audio and/or light are frequently referred to as mixers. Such control consoles or mixers are frequently used in darkened rooms, for example in theaters or multifunction halls. Even in studios where film sound mixing is done, the brightness is frequently determined by the video content of a displayed film or video material.

This makes it necessary to illuminate the control console independently of, however adapted to the brightness of the respective room. In the prior art, so-called gooseneck lamps are frequently used; these are often arranged at regular intervals over the entire width of a respective control console, and their brightness can usually be adapted to the respective illumination situations in the room. However, it is disadvantageous that it is necessary to install a large number of lights, which additionally have a relatively high energy consumption.

While earlier control consoles had rotary knobs, buttons, faders, and measuring instruments, etc., that were not illuminated, in modern control consoles almost all controls, measuring instruments, and displays are illuminated or self-illuminating. Therefore, separate illumination for the functional operation of a control console or mixer is only rarely required, or not even required at all.

However, the lighting devices known from the prior art, in particular in the form of gooseneck lamps, also serve the purpose of illuminating stage directions, scores, and similar plans about the course of or schedule for an event, the music provided for the sound track, etc., which are, as a rule, written or printed on paper, so that they can be read and understood by operators, even in the otherwise darkened room.

To hold such scores, plans, manuscripts, or similar things, some control consoles have reserved areas of the user interface where there are no controls or displays, to hold these scores, plans, or similar things. However, such an embodiment has the disadvantage that the total size of the control console increases in order to be able to accommodate the many controls and displays in addition to the place to put these scores, plans, or similar things.

Other embodiments of control consoles have a so-called mixer carriage or tray carriage, which is connected with the control console through coupling means and which is coupled to the control console so that it is moveable relative to its user interface. In such an embodiment, the mixer carriage is moveable relative to the user interface of the control console or mixer in such a way that this mixer carriage can be moved above the controls and display elements without changing them when it is moved. Thus, these controls and display elements are not touched.

An embodiment of such a mixer carriage is known from the utility model DE 92 01 334.1 U1, which describes a manuscript tray for a video mixer. It describes a rollable manuscript tray, in particular to hold up to two DIN A4 pages, for a video mixer, the manuscript tray being made of transparent acrylic glass and being movable over the entire length of the mixer using rollers. The substructure with the rollers is high enough that the tray can be guided over buttons and joysticks, which are in the form of control means in the video mixer, without touching them. A lower end has a lip arranged on it, which is intended to prevent paper put down on it from sliding off.

Optimal illumination of manuscripts, scores, and similar things on such a mixer or tray carriage is not solved in the prior art.

SUMMARY OF THE INVENTION

Thus, the invention has the goal of creating an improved mixer carriage and improved control equipment with a control console and a mixer carriage.

The invention is based on the idea of making the mixer carriage with at least one lighting device, which is provided for illumination of the tray surface. This makes it possible to achieve optimal illumination of manuscripts, scores, or similar things arranged on an tray surface of the mixer carriage, and to do so at any time and in any orientation or position, without using many lamps and without unnecessarily illuminating areas of the user interface of the control console or mixer.

In particular, a piece of audio- and/or video- and/or lighting control equipment comprising an audio and/or video and/or lighting control console and a mixer carriage is proposed, the mixer carriage comprising a tray body with a tray surface and coupling means, and the mixer carriage being couplable or coupled with the audio and/or video and/or lighting control console by means of the coupling means, so that the mixer carriage is moveable relative to a user interface of the audio and/or video and/or lighting control console, the invention providing that the tray body have at least one lighting device for illuminating the tray surface on it. It also proposes a mixer carriage for an audio and/or video and/or lighting control console that comprises a tray body with a tray surface and coupling means for a movable coupling with the audio and/or video and/or lighting control console, so that the mixer carriage is moveable relative to a user interface of the audio and/or video and/or lighting control console, it being provided that the tray body have at least one lighting device for illuminating the tray surface on it.

The invention offers the decisive advantage that if the controls and display elements of the user interface of the control console are self-illuminating or equipped with independent illumination, no large-area lighting devices are necessary on the mixer, and manuscripts, scores, or similar things can be illuminated using the lighting device of the mixer carriage itself, which always supplies optimal illumination of what is arranged on the mixer carriage, without having to illuminate other areas of the mixer along with it.

A preferred embodiment provides that the at least one lighting device is non-detachably fastened. This means that the lighting device is always available for the optimal illumination of manuscripts, scores arranged on the tray surface.

Embodiments that are especially preferred are those in which the at least one lighting device is fastened to a distal lateral edge of the tray body. This ensures that the lighting device itself does not at all interfere with a reach area of persons who operate the mixer or the control console, or does so as little as possible. This also makes it possible to turn the pages of scores and write on documents that are put down on the tray surface, etc.

The distal side or distal lateral edge of a tray body designates that side of the mixer carriage or its tray surface which is distanced from that side of the control console on which persons are located who operate controls arranged on the user interface in normal use. Generally, labeling on an operator console is made so that it can be read and understood without problems from the operator side. This side of the operator console is designated as the proximal side. Accordingly, the edge of the mixer carriage or the tray surface facing the operator side of the control console is also designated as the proximal edge or side.

To prevent the lamps of the at least one lighting device from illuminating parts of the mixing desk or control console on which no manuscripts, scores, or similar things have been laid, and most importantly also to avoid blinding the persons who operate the controls arranged on the user interface and read the displays, a preferred embodiment provides that the at least one lighting device have means of shading and light guidance which prevent the emission of light of the at least one lighting device beyond a proximal lateral edge of the tray surface. On this lateral edge of the tray surface, the tray body preferably has a lip or something similar to provide a mechanical barrier for documents such as scores, manuscripts, or similar things that have been laid on the tray surface, so that their sliding down or projecting beyond the edge of the tray surface is avoided or prevented. The means of shading and light guidance can comprise, for example shades, but also mirrors, lenses, or similar things that influence the guidance of the light of the at least one lighting device.

Preferably the means of shading and light guidance in some embodiments are in the form of a lamp housing. Preferably the outside surfaces, which are also called lateral faces, of the lamp housing are made of a material that is opaque and impervious to light. In particular, metal is a suitable material. In other embodiments, the material can be an opaque plastic.

To ensure that the only light that strikes the illuminated area is that which propagates in a straight line from a lamp, the insides of the outside surfaces of the lamp housing are preferably made to be absorbent. Thus, these insides do not reflect any light. This can be achieved by making the inner surfaces black.

Preferably, the means of shading and light guidance are made in such a way that they limit the emission of light to an illuminated area that does not extend beyond the tray surface in the plane of the tray surface. This ensures that parts of the user interface not hidden by the mixer carriage are not illuminated by the light of the at least one lighting device, which can make it more difficult to read self-illuminating displays and/or control devices.

Optimal illumination of the illuminated area is achieved in an embodiment in which the means of shading and light guidance are in the form of a lamp housing, if the lamp housing is enclosed light-tight on five sides. The sixth side forms an exit opening for the light. Depending on the position of the lamp housing relative to the tray surface or the illuminated surface on it, outer edges of the lateral faces that border the exit opening and define it, are selected in such a way that they limit rectilinear propagation of the light of the lamp(s) arranged in the lamp housing into a plane in which the illuminated area of the tray surface lies, to a region of this plane that lies completely in the tray surface. I.e., the illuminated area does not project beyond the tray surface of the mixer carriage. For example, the lamp housing can be in the form of a box or rectangular cuboid. One or more lamp(s) are then arranged on or near a floor of the lamp housing in the form of a box or rectangular cuboid. The insides are preferably made absorbent. The heights of the side walls or lateral faces, which form the outside surfaces, and their angle of tilt with respect to the floor or a reference plane on the floor of the lamp housing are determined so that rectilinear propagation of light from the lamp or, if multiple lamps are present, from all lamps only illuminates the tray surface of the mixer carriage. Other light is absorbed on the lateral faces.

To allow optimal adaptation of the illuminated area to the real surface of the documents arranged on the tray surface, the means of shading and light guidance in one embodiment are changeable, so that the illuminated area is changeable in the plane of the tray surface.

In particular, in a lamp housing it is possible for the side lateral faces of the lamp housing to have a variable height and/or a variable angle of tilt with respect to the floor or the reference plane. The side lateral faces are those that are oriented transverse to the proximal edge of the tray surface or of the mixer carriage.

In one embodiment, it is possible to provide that the means of shading and light guidance also allow illumination of areas extending beyond the side of the mixer carriage, to make it possible to illuminate especially large scores or similar things. However, even in such an embodiment the means of shading and light guidance are preferably designed so that a maximum illuminated area in the plane of the tray surface transverse to a displacement direction along which the mixer carriage is moveable relative to the user interface, is limited at least by the proximal edge of the tray body and preferably additionally by the distal edge of the tray body and its respective imaginary extension. This at least prevents blinding of persons who operate the control devices on the user interface or monitor and read its displays. It is ensured that operators cannot be blinded by the light of the at least one lighting device.

In one embodiment, the at least one lighting device has one or more lamp stems that are made of a material that is transparent to visible light. This or these lamp stem(s) are preferably fastened to the distal lateral edge of the tray body. This allows objects that are located behind the lamp stems and hidden by them to be viewed, and limits or impedes view of them only as much as necessary.

In a preferred embodiment, the tray body itself, or at least the tray surface of the tray body, are also made of a material that is transparent to visible light. Thus, preferred materials are, for example, acrylic glass, for example poly(methyl methacrylate) glass, or also normal window glass or crystal glass. An advantage of acrylic glasses is their weight, which is substantially less than that of normal window glass or crystal glass. Other transparent plastics can also be used.

To be able to supply energy to one or more lamps of the at least one lighting device, the tray body has energy supply means to supply energy to the lamp(s) for the at least one lighting device. The energy supply means can comprise, for example, an electrochemical energy storage, for example in the form of a battery or an accumulator. It is especially preferred to use lithium ion-based rechargeable batteries or accumulators. Alternatively, nickel-metal hydride batteries or accumulators or non-rechargeable batteries can also be used.

Alternatively or additionally, the energy supply means can also comprise sliding contacts, which form an electrical contact with one or more electrical conductors. One or two electrical contact surfaces for the energy supply of the at least one lighting device can extend in a longitudinal direction, along which the manuscript carriage can be displaced on the user interface, so that the sliding contacts make electrical contact in every position. In other embodiments, such electrical contact surfaces are only made at certain positions of the user interface. It is then possible for the mixer carriage to be "parked" at times when it is not required and for an electrically conductive connection to be made through the sliding contacts, to charge up an energy storage, for example an accumulator or a rechargeable battery of the mixer carriage. This embodiment offers the advantage that it is not necessary for electrical contact surfaces to extend over the entire length of the mixer.

Alternatively or in addition to the sliding contacts, the energy supply can also comprise one or more induction systems, so that electrical energy can be coupled into the mixer carriage without contact. Here it is also possible for the mixer to have electrical contact surfaces or conductor surfaces along its longitudinal axis, to couple energy into the mixer carriage through an alternating field at any time, or it can have them only at certain positions to couple electrical energy into the mixer carriage without contact in these "park positions", to allow an energy storage to be recharged.

As a rule, the coupling means through which the mixer carriage is coupled with the control console are in the form of rollers on the tray body. As a rule, there are four rollers. However, other embodiments can also provide a different number of rollers, for example three or more than four.

The user interface of the control console preferably has rails, on or against which the rollers of the tray body or mixer carriage lie.

The rails can be conductive, to form the electrical contact surfaces with which the energy supply means or their components interact. Here a rail can be in the form of one contact surface or also divided in the longitudinal direction, providing, in this way, multiple electrical contact surfaces that are insulated from one another. If the rails are made conductive and the rollers are also made conductive, then the rollers can also be a component of the energy supply means, and electrical energy can be fed in through the rollers.

The preferred lamps to use are light-emitting diodes, since they have an especially low energy demand and at the same time their brightness can be adjusted well.

BRIEF DESCRIPTION OF THE SEVERAL VIEWS OF THE DRAWING

The invention will be explained in detail below with reference to a drawing. The figures are as follows.

DESCRIPTION OF THE INVENTION

Figure 1:
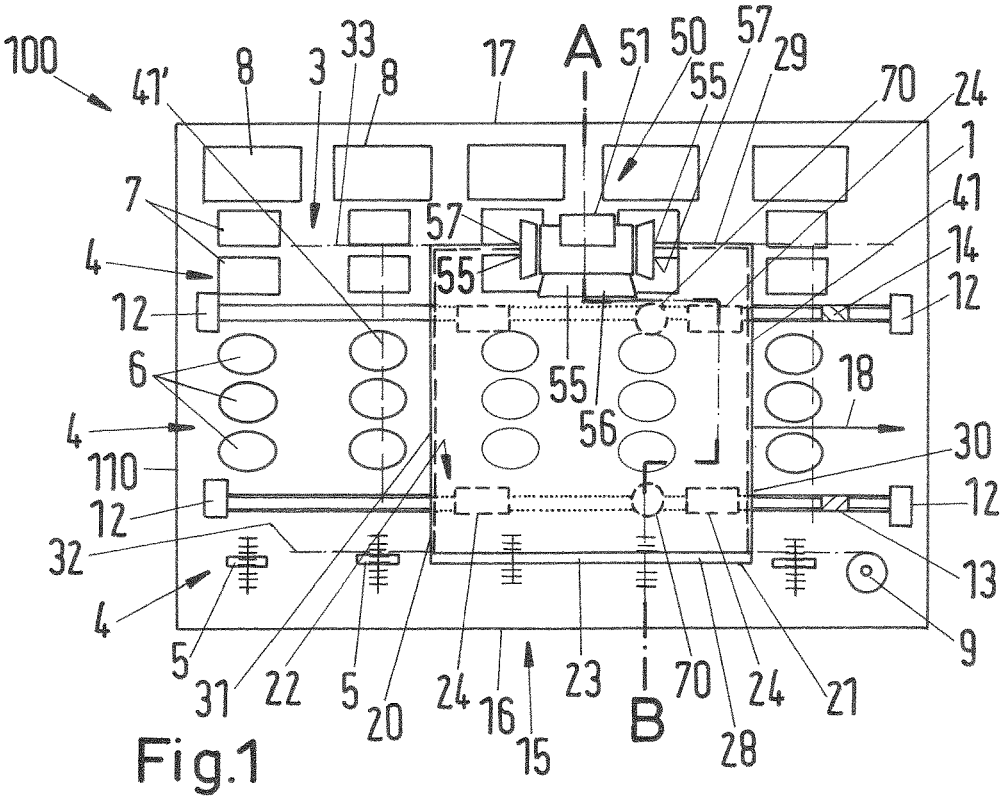
FIG. 1 A schematic top view of a piece of control equipment with a control console and a mixer carriage.

FIG. 1 shows a schematic top view of a piece of control equipment 100. It comprises an audio and/or video and/or lighting control console, which is designated here as control console 1 for short. For example, the control console is in the form of a mixer 110. In addition to the control console 1, the piece of control equipment 100 comprises a so-called mixer carriage 20.

Figure 2:
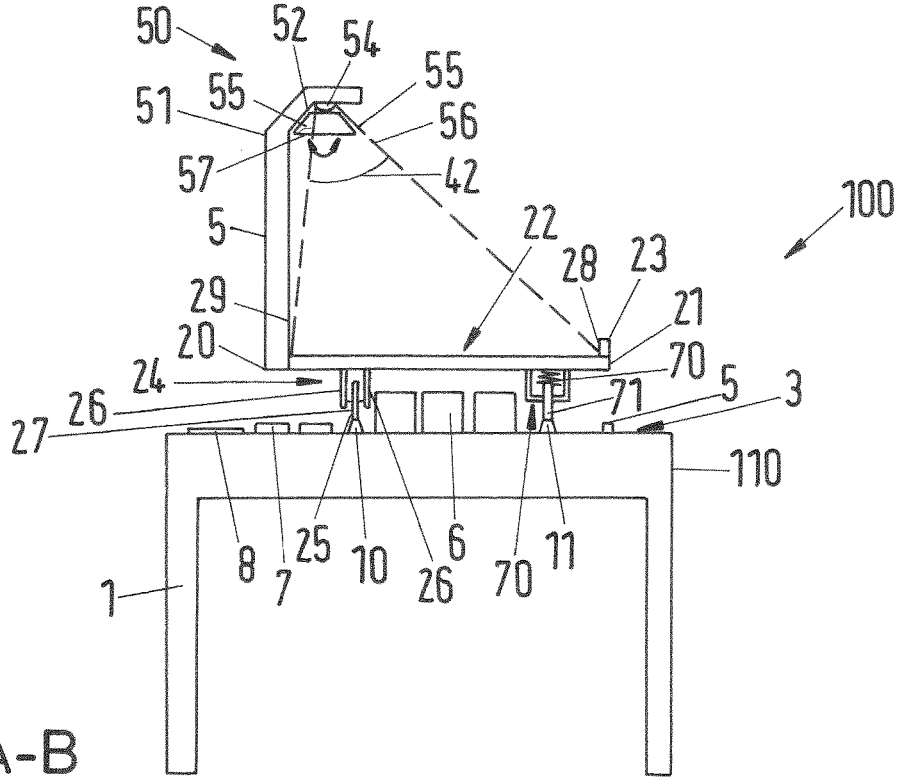
FIG. 2 A schematic sectional view of a piece of control equipment with a control console and a mixer carriage according to FIG. 1.

FIG. 2 shows a schematic sectional view A-B of the piece of control equipment 100 with the control console 1 and the mixer carriage 20 according to FIG. 1.

The control console 1 comprises a table 2 with a user interface 3. The user interface 3 has many control devices 4 on it, for example, in the form of faders 5, rotary encoders 6, buttons 7, and/or a joystick 9.

In addition, there are displays 8 for visualizing measurements, for example. The specifically mentioned control devices 4 and displays 8 are only mentioned as examples. The control console can have different control devices 4 or displays 8, e.g., touchscreens etc. The control devices 4 and displays 8 shown here are only shown as examples. The user interface 3 or the top of the table 2 has a rail 10 and another rail 11 made on it or fastened to it. The rail 10 and the other rail 11 can be convex, as in the example shown, or also concave. Coupling means 24 of the mixer carriage 20 in the form of rollers 25 are in contact with the rail 10 and the other rail 11, these coupling means 24 allowing the mixer carriage to be displaced in a longitudinal direction 18 of the user interface 3 of the control console 1. Stops 12 at the ends of the rail 10 and the other rail 12 limit a travel path or displacement path of the mixer carriage 20 on a left lateral edge 61 and a right lateral edge 62 of the control console 1.

If the rail 10 and the other rail 11 are concave, then the rollers 25 are preferably convex. By contrast, if the rail 10 and the other rail 11 are, as in the example shown, convex, then the contact surfaces of the rollers 25 are preferably concave. This ensures optimal guidance of the mixer carriage transverse to the longitudinal direction 18, along which the rail 10 and other rail extend and along which the mixer carriage 20 can be displaced.

The mixer carriage 20 comprises a tray body 21 with a tray surface 22. On this tray surface 22 it is possible to put down manuscripts, scores, plans, or similar things (not shown). A proximal side or proximal lateral edge 29 of the mixer carriage 20 has a lip 23 that forms a mechanical limit of the tray surface 22 [in the direction] transverse to the longitudinal direction 18 along which the mixer carriage 20 can be displaced above and over the user interface 3.

To be able to illuminate papers and documents, such as, for example, a score, a schedule, or similar things that have been put down on the tray surface 22 of the mixer carriage 20, the mixer carriage 20 has a lighting device 50. This lighting device 50 comprises a lamp stem 51, which is fastened to or made on the distal lateral edge 28 of the mixer carriage 20. An end of the lamp stem 51 that is separated from the tray surface 22 has a lamp 52 arranged on it. This lamp is, for example, in the form of an LED. In order to direct the light produced by the lamp 52 onto the tray surface 22 and to produce a delimited illuminated area 40 there, the lighting device 50 has means of shading and light guidance 53. These means can have, for example, a reflector 54, which has a certain light guidance effect. In addition, the means of shading and light guidance 53 comprise shading elements 55. In the example shown, the shading elements 55 comprise a rigid shade 56 and changeable movable shades 57. The rigid shade 56 is oriented so that light emitted from the lamp does not go beyond the proximal lateral edge 29. This prevents the blinding of persons at the control console 1 who operate the control devices 4 arranged on the user interface 3.

In one embodiment, the means of shading and light guidance 53 are designed so that a maximum illuminated area 41 in a plane of the tray surface 22 of the mixer carriage 20 is limited to the tray surface 22. In another embodiment, the movable shades 57 of the shading elements 55 can be varied so that a maximum illuminated area 41' extends beyond a right lateral edge 30 and/or a left lateral edge 31 of the mixer carriage. However, in order to prevent blinding of the operators, a preferred embodiment provides that the means of shading and light guidance 53 be designed so that even in such an embodiment the maximum illuminated area 41, 41' in the plane of the tray surface 22 does not project beyond the proximal lateral edge 29 or its imaginary extension 32. Moreover, the maximum illuminated area is preferably also limited at the distal lateral edge 28 and its imaginary extension 33.

In one embodiment in which the maximum illuminated area 41 is limited entirely to the area of the tray surface 22, illumination of the user interface to the side of the mixer carriage by light of the lighting device 50 is prevented. This has the result that the readability of display elements and/or control outputs, which are displayed next to control devices 4 on the user interface 3, is not affected.

In order to supply electrical energy to the one lamp 52 or more lamps of the at least one control device 50, the tray body 21 of the mixer carriage 20 has energy supply means 70 made and/or arranged on it. FIG. 2 shows a sectional view A-B of the embodiment in which a contact pin 71 can be seen that is prestressed with a spring 72. This contact pin is in contact with the rail 10, which is conductive in the sample embodiment shown. Another contact pin 73 of the same kind is in contact with the other rail 11 (see FIG. 1). These other rails are also conductive. Alternatively, the rail 10 and the other rail 11 could also be conductive only in contact sections 13, 14 or at other places on the mixer through which the supply of power to the mixer carriage 20 is possible in a certain position, called the park position, of the mixer carriage relative to the user interface 3. In such an embodiment, the energy supply means preferably comprise an energy storage (not shown), for example in the form of a lithium ion accumulator.

In yet another embodiment, the energy supply means can alternatively or additionally comprise an induction system through which electrical energy can be coupled into the mixer carriage 20 in a contactless manner. To accomplish this, it is possible to feed an alternating voltage into the rail 10 and/or the other rail 11, for example. In such an embodiment it is also possible for an alternating magnetic induction field to be emitted only in the area of a park position of the mixer carriage.

The mixer carriage 20 and the control console 1 are preferably designed so that the mixer carriage can, if it is not required, be lifted off the control console.

Figure 3:
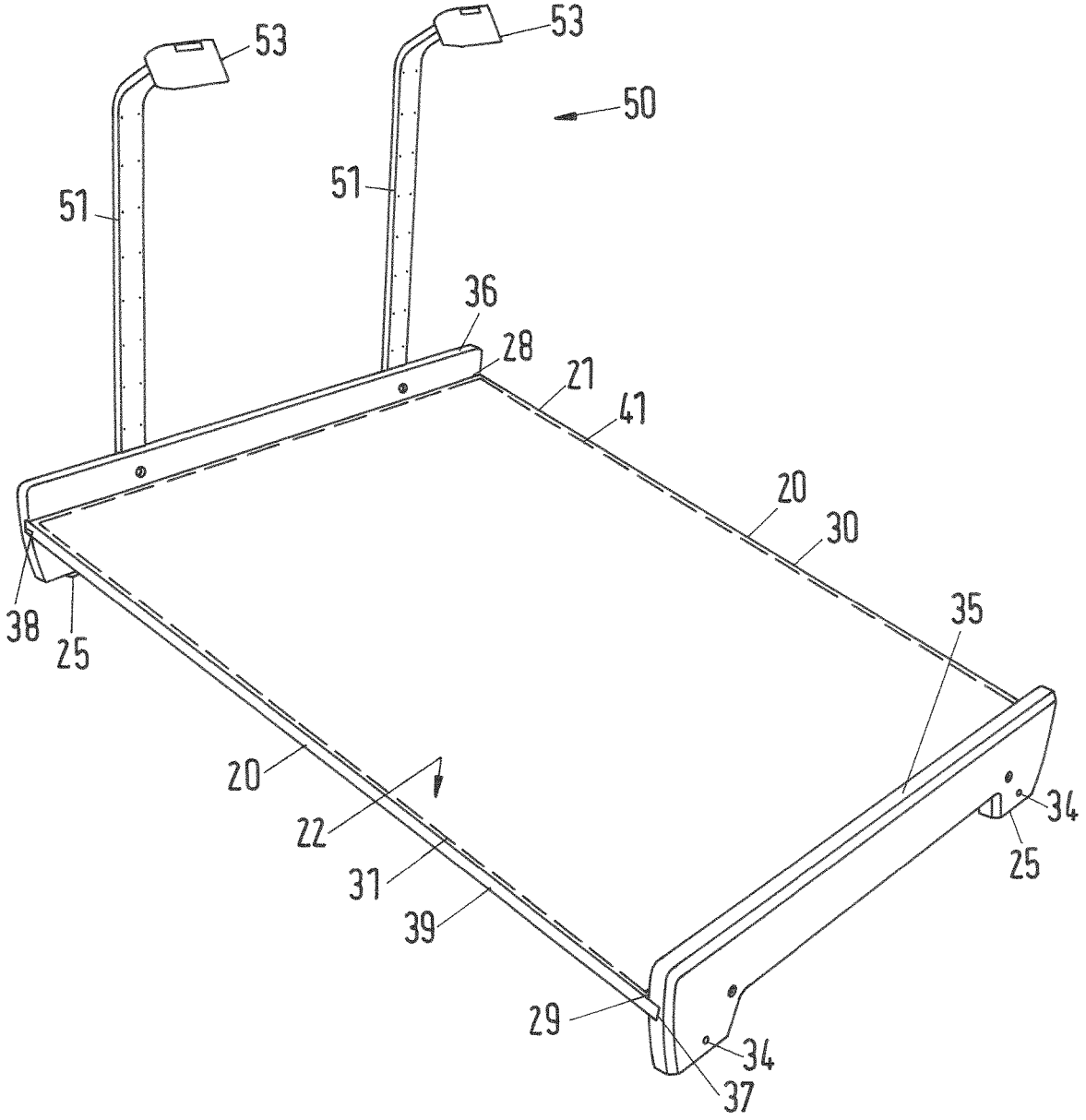
FIG. 3 An isometric view of a mixer carriage with a lighting device.

FIG. 3 shows an isometric view of another embodiment of a mixer carriage 20'.

The tray body 21' comprises a proximal end piece 35 and a distal end piece 36, which are arranged on the proximal lateral edge 29 or the distal lateral edges 30 of the mixer carriage 20'. The proximal end piece 35 and the distal end piece 36 have openings in them which serve to hold the coupling means in the form of rollers 25. In the proximal end piece 35, the ends of the axles 34 for the rollers 25 can be seen. The proximal end piece 35 and the distal end piece 36 each have a groove 37 or 38 into which a tray plate 39 is inserted. Preferably, the proximal end piece 35 and the distal end piece 36 and the tray plate 39 are transparent, so that it is possible to see through them, if nothing is arranged on the tray surface 22 of the tray plate 39.

The distal end piece 36 has two lamp stems 51,51*a* screwed onto it, which preferably are also transparent for light in the visible wavelength spectrum. At an upper end, each of the lamp stems 51,51*a* is slightly bent. The bent sections of the lamp stems 51, 51*a* have lamps (not visible) arranged on them, whose light propagation is limited by means of shading and light guidance 53 in the form of rigid shades in such a way that no light of the lamps goes beyond the proximal lateral edge 29 or an imaginary extension 32 of the proximal lateral edge 29. Preferably, the means of shading and light guidance 53 are also made in such a way that there is also no light of the lighting device 50, i.e., no light of the lamps arranged on the lamp stems 51 and 51*a* that goes beyond the left lateral edge 29 and the right lateral edge 30 of the mixer carriage 20. It is especially preferred for the maximum illuminated area 41 in the plane of the tray surface 22 to be limited to the area of the tray surface 22.

In this embodiment, the energy supply means are in the form of spring-loaded carbon contact pins, which cannot be seen in the Figure. Electrical conductors, which can be in the form of copper wires, for example, conduct the electrical energy to the lamps. The copper wires can be cast inside the elements that are preferably made of acrylic glass. Alternatively, the conductor tracks can be made using transparent substances, such as, for example, zinc oxide, so that the transparency of the tray plate 39 and the lamp stems 51, 51*a* is not affected. Conductor tracks made of copper, or also of a transparent material, that are inside the individual components offer the advantage that they are protected from damage.

Figure 4:
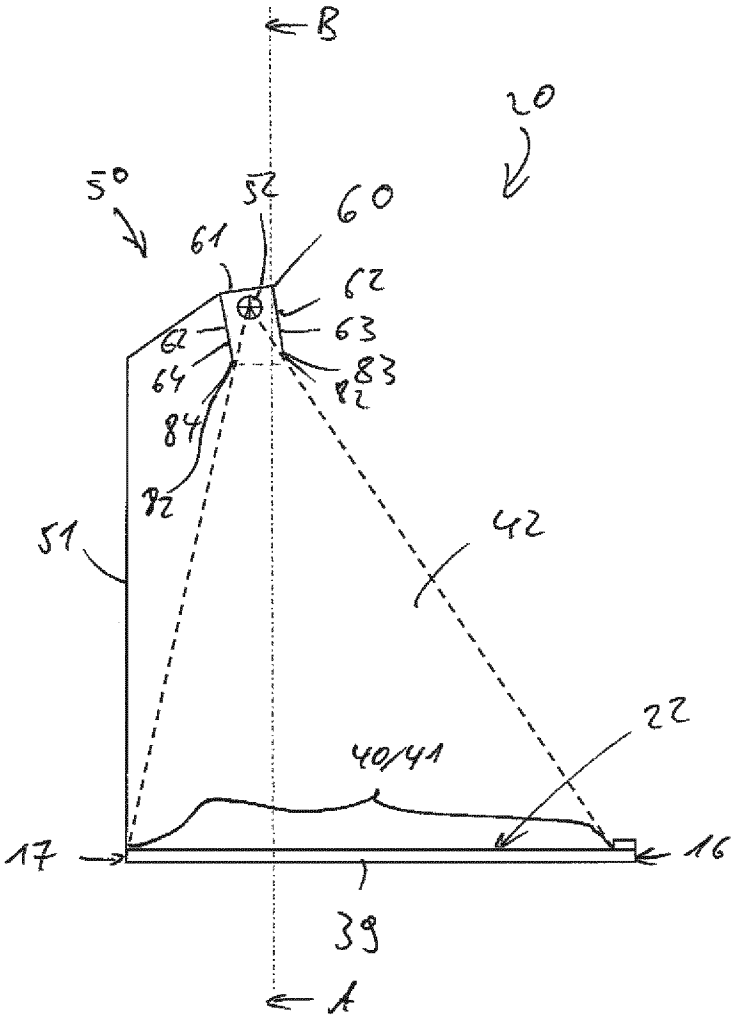
FIG. 4 A schematic sectional view through a tray plate and a lighting device of a mixer carriage transverse to the proximal and distal lateral edges of the tray plate, the means of shading and light guidance being in the form of an unchangeable lamp housing.

FIG. 4 shows a schematic sectional view through a tray plate 39 and a lighting device 50 of a mixer carriage 20 transverse to the proximal side 16 and distal side 17 of the tray surface 22, the means of shading and light guidance 53 being in the form of an unchangeable lamp housing 60. The lamp housing 60 is in the form of a box. It has a floor 61 and lateral faces 62. The lateral faces 62 comprise a front or proximal lateral face 63, a rear or distal lateral face 64, and a right lateral face (not shown) and a left lateral face (not shown). Right and left should each be understood as they would be by a user who is viewing the proximal side 16 (see FIG. 5).

Close to the floor, a lamp 52 is arranged, which is preferably in the form of a point source of light. It is especially preferred if a white LED is used. It is also possible for multiple LEDs to be used, which preferably are arranged next to one another parallel to the proximal lateral face 63. The outer edges 82 of the lateral faces 62 of the lamp housing 60 have distances to the floor 61 of the lamp housing 60, i.e., they have heights, that are selected in such a way that a light cone 42 resulting from the rectilinear propagation of light from the lamp(s) 52 produces a maximum illuminated area 41 in a plane of the tray plate 39 or tray surface 22 that lies completely within the tray plate 39, and thus does not project beyond it.

Figure 5:
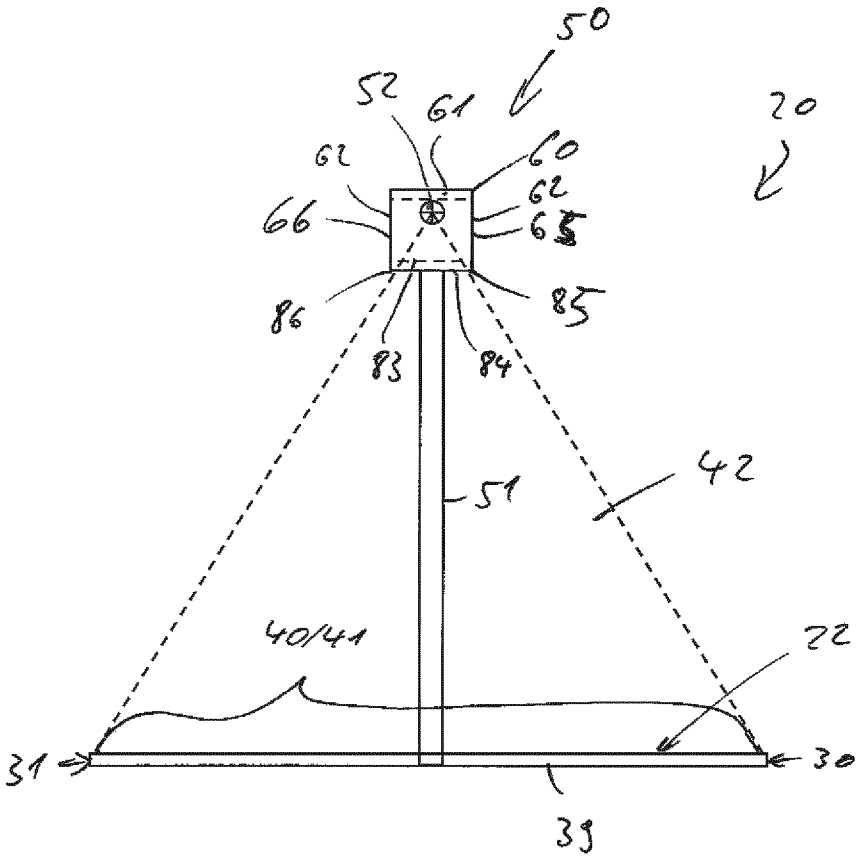
FIG. 5 A schematic sectional view through the tray plate and the lighting device of the mixer carriage along a line A-B according to FIG. 4 parallel to the proximal and distal lateral edges of the tray plate, the means of shading and light guidance in the form of an unchangeable lamp housing.

FIG. 5 shows the corresponding schematic sectional view along the line A-B in FIG. 4, i.e., transverse to the proximal side, through the tray plate 39 and the lighting device 50 of the embodiment according to FIG. 4. It is possible to see the right lateral face 65 and the left lateral face 66 of the lamp housing 60, and the floor 61 and the distal lateral face 64. A position of the outer edge 83 of the proximal lateral face is suggested by a dashed line. It can easily be seen that the light cone 42 does not project beyond either the right lateral edge 30 or the left lateral edge 31 of the tray plate 39.

Figure 7:
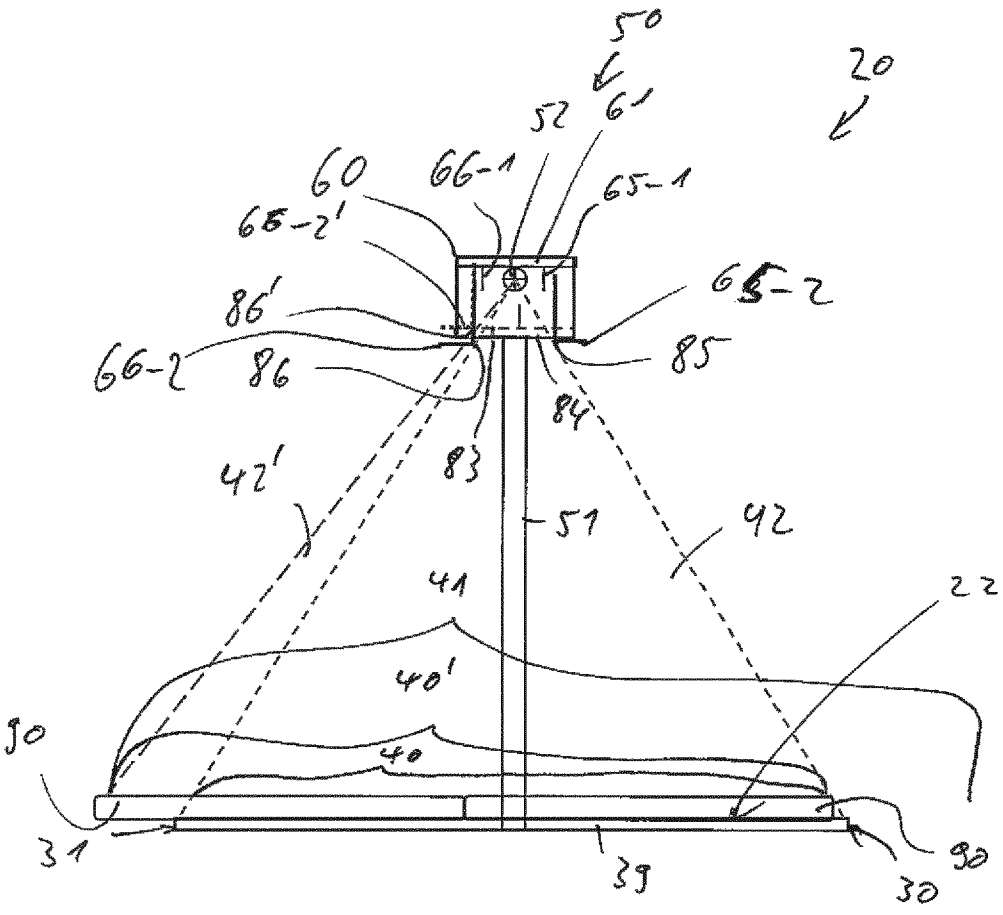
FIG. 7 A schematic sectional view through the tray plate and the lighting device of the mixer carriage along a line A-B according to FIG. 6 parallel to the proximal and distal lateral edges of the tray surface, the means of shading and light guidance being in the form of a changeable lamp housing, this view additionally showing a score that is arranged on the tray plate and that projects beyond a left lateral edge.
Figure 6:
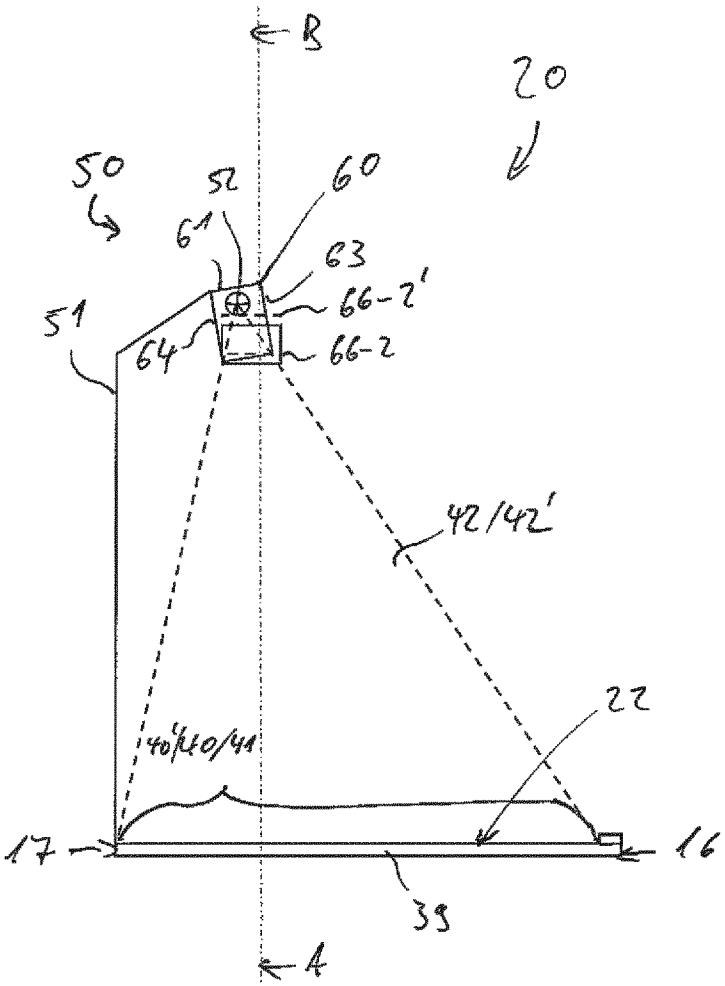
FIG. 6 A schematic sectional view through a tray plate and a lighting device of a mixer carriage transverse to the proximal and distal lateral edges of the tray plate, the means of shading and light guidance being in the form of a changeable lamp housing.

FIGS. 6 and 7 show schematic views similar to those in FIGS. 4 and 5, however the lamp housing 60 has a variable right lateral face 65 and a variable left lateral face 66. Each of these comprises a rigid part 65-1, 66-1 and a moveable section 65-2, 66-2 mounted so that it can be slid in a corresponding slot in the proximal lateral face 63. The moveable sections 65-2, 66-2 make it possible to vary the distances of the corresponding outer edges 85, 86 from the floor 61 of the lamp housing 60, to adapt the illuminated area 40, 40' in an optimal manner. One embodiment can provide that the maximum illuminated area that is adjustable nevertheless does not project beyond the tray plate 39 or the tray surface 22. It is advantageous to prevent reflections off areas of the tray plate that are not be covered by a manuscript or similar things. Optimally, it is possible to see through these areas, if the tray plate 39 is transparent.

In the embodiment shown here, the illuminated area 40 can be enlarged to the right and left of the tray plate 39, so that the maximum illuminated area 41 projects beyond the right lateral edge 30 and the left lateral edge 31. However, the maximum illuminated area 41 is still limited on the proximal and distal side. In the view shown in FIG. 7, the tray plate 39 additionally has a score 90 put down on it, which for simplicity is omitted from the corresponding view in FIG. 6. FIG. 7 shows the moveable section 66-2' in a position indicated by dotted lines in which the illuminated area 40' is adapted to the score 90 projecting beyond the tray plate 39 on the left. In the other position of the moveable section 66-2, which is indicated by a solid line, the illuminated area 40 is limited to the tray plate 39.

For clarity, FIG. 4-7 does not show the coupling means of the mixer carriage.

For the person skilled in the art it follows that other alternative embodiments of a mixer carriage or a control console are conceivable. For instance, the coupling of the mixer carriage with the control console can also be done through a magnetic support, for example.

The different features described in the various embodiments can be combined with one another to implement the invention.

LIST OF REFERENCE NUMBERS

1 Control console
2 Table
3 User interface
4 Control devices
5 Faders
6 Rotary encoders
7 Buttons
8 Display
9 Joystick
10 Rail
11 Other rail
12 Stops
13, 14 Contact surfaces
15 Operator side
16 Proximal side
17 Distal side
18 Longitudinal direction
20 Mixer carriage
21 Tray body
22 Tray surface
23 Lip
24 Coupling means
25 Roller
26 Roller holder
27 Axle
28 Distal lateral edge
29 Proximal lateral edge
30 Right lateral edge
31 Left lateral edge
32 Imaginary extension of proximal lateral edge
33 Imaginary extension of distal lateral edge
34 Ends of the axles
35 Proximal end piece
36 Distal end piece
37, 38 Groove
39 Tray plate
40, 40' Illuminated area
41,41' Maximum illuminated area
42, 42' Light cone
43 Dashed lines
50 Lighting device
51 Lamp stem
52 Lamp
53 Means of shading and light guidance
54 Reflector
55 Shading element
56 Rigid shade
57 Movable shade
60 Lamp housing
61 Floor
62 Lateral faces
63 Proximal lateral face
64 Distal lateral face
65 Right lateral face
65-1 Rigid section of right lateral face
65-2 Moveable section of right lateral face
66 Left lateral face
66-1 Rigid section of left lateral face
66-2, 66-2' Moveable section of left lateral face
70 Energy supply means
71 Contact pin
72 Spring
82 Outer edges of lateral faces of the lamp housing
83 Outer edge of proximal lateral face
84 Outer edge of distal lateral face

85 Outer edge of right lateral face
86, 86' Outer edge of left lateral face
90 Score
100 Control equipment
110 Mixer

The invention claimed is:

1. A mixer carriage for a control console selected from the group consisting of an audio control console, a video control console, a lighting control console, an audio-video control console, an audio-lighting control console, a video-lighting control console and an audio-video-lighting control console, the control console having a proximal side and an opposite distal side, and the proximal side faces a user of the mixer carriage, the mixer carriage comprising:

a tray body having a tray surface and a distal lateral edge;

a coupler for a movable coupling with the control console so that the mixer carriage is moveable relative to a user interface of the control console such that said distal lateral edge of said tray body faces the distal side of the control console;

at least one lighting device disposed on said tray body for illuminating said tray surface, said at least one lighting device is coupled to said distal lateral edge and extending completely above said tray body; and at least one enemy coupling means selected from the group consisting of sliding contacts and induction systems for receiving enemy in a contactless manner from an alternating magnetic field.

2. The mixer carriage according to claim 1, wherein said at least one lighting device is fastened in a non-detachable manner.

3. The mixer carriage according to claim 1, wherein said tray body has a proximal lateral edge and said at least one lighting device has means of shading and light guidance that prevent an emission of light of said at least one lighting device beyond said proximal lateral edge of said tray body.

4. The mixer carriage according to claim 3, wherein said means of shading and light guidance are changeable, so that an illuminated area in a plane of said tray surface is changeable.

5. The mixer carriage according to claim 3, wherein said means of shading and light guidance limit the emission of the light to an illuminated area that does not extend beyond said tray surface in a plane of said tray surface.

6. The mixer carriage according to claim 3, wherein:

said means of shading and light guidance are configured so that a maximum illuminated area in a plane of said tray surface transverse to a displacement direction along which the mixer carriage is moveable relative to the user interface, is limited at least by said proximal lateral edge of said tray body and additionally by said distal lateral edge of said tray body and its respective imaginary extensions.

7. The mixer carriage according to claim 1, wherein said at least one lighting device has at least one lamp stem made from a material that is transparent to visible light.

8. The mixer carriage according to claim 1, wherein said tray surface of said tray body is transparent to visible light.

9. The mixer carriage according to claim 1, wherein said at least one lighting device has at least one lamp; and further comprising energy supply means disposed on said tray body for supplying energy to said lamp of said at least one lighting device.

10. The mixer carriage according to claim 9, wherein said coupler has rollers that are configured to lie on or against rails of the control console and allow the mixer carriage with said at least one lighting device to move in a longitudinal direction of the control console.

11. The mixer carriage according to claim 10, wherein:

said coupler has coupling elements; and the user interface has, disposed on it, at least two rails on which said coupling elements lie when the mixer carriage is in a coupled state or into which said coupling elements engage when the mixer carriage is in the coupled state, parts of at least one of the rails being made conductive to allow energy to be fed through said energy supply means by applying electric current.

12. A piece of control equipment selected from the group consisting of audio control equipment, video control equipment, lighting control equipment, audio-video control equipment, audio-lighting control equipment, video-lighting control equipment and audio-video-lighting control equipment, the piece of control equipment comprising:

a control console selected from the group consisting of an audio control console, a video control console, a lighting control console, an audio-video control console, an audio-lighting control console, a video-lighting control console and an audio-video-lighting control console, said control console having a user interface with a distal side and an opposite proximal side facing a user interacting with the user interface;

a mixer carriage having a tray body with a tray surface and a distal lateral edge and a coupler, said mixer carriage being couplable or coupled with the said control console by means of said coupler, so that said mixer carriage is moveable relative to said user interface of said control console and that said distal lateral edge of said tray body faces said distal side of said user interface;

at least one lighting device disposed on said tray body for illuminating said tray surface, said at least one lighting device is coupled to said distal lateral edge and extending completely above said tray body; and at least one energy coupling means selected from the group consisting of sliding contacts and induction systems for receiving energy in a contactless manner from an alternating magnetic field.

13. The piece of control equipment according to claim 12, wherein said tray body has a proximal lateral edge and said at least one lighting device has means of shading and light guidance that prevent an emission of light of said at least one lighting device beyond said proximal lateral edge of said tray body.

14. The piece of control equipment according to claim 13, wherein said means of shading and light guidance limit the emission of the light to an illuminated area that does not extend beyond said tray surface in a plane of said tray surface.

15. The piece of control equipment according to claim 13, wherein:

said means of shading and light guidance are configured so that a maximum illuminated area in a plane of said tray surface transverse to a displacement direction along which said mixer carriage is moveable relative to said user interface, is limited at least by said proximal lateral edge of said tray body and additionally by said distal lateral edge of said tray body and its respective imaginary extensions.

16. The piece of control equipment according to claim 12, wherein said at least one lighting device has at least one lamp stem made from a material that is transparent to visible light.

17. The piece of control equipment according to claim 12, wherein said at least one lighting device has at least one lamp;

further comprising energy supply means disposed on said tray body for supplying energy to said lamp of said at least one lighting device;

wherein said control console has rails; and wherein said coupler has rollers that are configured to lie on or against said rails of said control console.

* * * * *